US008602028B2

(12) United States Patent
Cree

(10) Patent No.: US 8,602,028 B2
(45) Date of Patent: Dec. 10, 2013

(54) CONSTANT MASS OXYGEN ADDITION INDEPENDENT OF AMBIENT PRESSURE

(75) Inventor: Robert E. Cree, Newark, NY (US)

(73) Assignee: Dive Cobalt Blue, LLC, Newark, NY (US)

( * ) Notice: Subject to any disclaimer, the term of this patent is extended or adjusted under 35 U.S.C. 154(b) by 267 days.

(21) Appl. No.: 13/016,673

(22) Filed: Jan. 28, 2011

(65) Prior Publication Data

US 2012/0192866 A1 Aug. 2, 2012

(51) Int. Cl.

| | |
|---|---|
| ***A62B 9/02*** | (2006.01) |
| ***A62B 7/10*** | (2006.01) |
| ***A62B 19/00*** | (2006.01) |
| ***A62B 23/02*** | (2006.01) |

(52) U.S. Cl.
USPC ..... 128/205.24; 128/205.12

(58) Field of Classification Search
USPC ..... 128/204.18, 200.24, 204.26, 205.11, 128/205.12, 205.24, 204.29; 137/81.2, 100, 137/102
See application file for complete search history.

(56) References Cited

U.S. PATENT DOCUMENTS

| | | | | |
|---|---|---|---|---|
| 4,939,647 | A | 7/1990 | Clough et al. | |
| 4,994,117 | A | 2/1991 | Fehder | |
| 5,924,418 | A | 7/1999 | Lewis | |
| 6,003,513 | A | 12/1999 | Readey et al. | |
| 6,302,106 | B1 * | 10/2001 | Lewis | 128/204.22 |
| 6,408,847 | B1 | 6/2002 | Nuckols et al. | |
| 6,526,971 | B2 | 3/2003 | Kellon | |
| 6,712,071 | B1 | 3/2004 | Parker | |
| 2001/0015203 | A1 | 8/2001 | Cumming | |
| 2009/0250062 | A1 * | 10/2009 | Reynolds | 128/205.24 |
| 2010/0012124 | A1 | 1/2010 | Deas | |
| 2012/0192868 | A1 * | 8/2012 | Cree | 128/205.24 |

FOREIGN PATENT DOCUMENTS

WO 99/03524 1/1999

OTHER PUBLICATIONS

U.S. Appl. No. 13/016,664, filed with the USPTO Jan. 28, 2011 (34 pages).
U.S. Appl. No. 13/016,690, filed Jan. 28, 2011 (20 pages).

* cited by examiner

*Primary Examiner* — Kristen Matter
(74) *Attorney, Agent, or Firm* — Brian B. Shaw, Esq.; Harter Secrest & Emery LLP

(57) ABSTRACT

A constant mass oxygen addition device for use with a rebreathing apparatus is disclosed for use by individuals venturing into harsh environments, particularly the underwater environment, that remains unaffected by ambient pressure changes. This constant mass oxygen addition device comprises an intermediate chamber which is first pressurized with regulated pressure gas containing oxygen to a set value greater than ambient pressure and then subsequently vented to ambient pressure. This defines one constant mass dosing cycle. Multiple constant mass dosing cycles are repeated sequentially on a periodic basis sufficient to replace metabolic oxygen used by the individual and can be controlled either electronically or preferentially independent of electronics and linked to the respiratory rate of the diver. If desired, adjustment of the delivered oxygen mass for each cycle is accomplished by mechanically adjusting the volume of the intermediate chamber or by altering the regulation pressure of the connected oxygen supply.

17 Claims, 5 Drawing Sheets

CONSTANT MASS OXYGEN ADDITION INDEPENDENT OF AMBIENT PRESSURE

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A "SEQUENCE LISTING"

Not applicable.

FIELD OF THE INVENTION

The present system relates to constant mass oxygen addition in a re-breathing apparatus independent of ambient pressure.

BACKGROUND OF THE INVENTION

For individuals venturing into underwater environments, breathable gas is typically delivered from a compressed gas storage tank and demand system known as SCUBA (Self Contained Underwater Breathing Apparatus). The most common form termed open circuit, releases pressurized gas through a regulator which contains a diaphragm located adjacent the diver's mouth that senses and is responsive to the divers breathing pressure. The diaphragm acts to move a demand valve to deliver breathing gas to the diver when required and all subsequently exhaled gas typically passes back into the regulator and is directed through a one way valve into the surrounding environment where it is permanently lost for use by the diver. During inhalation, the one way valve seals the regulator off from the surrounding environment to prevent water from back flowing and choking the diver. The sensitivity of present art regulators is such that very little effort is required to inhale or exhale underwater. Since open circuit gas is used only once, divers are required to carry a large volume of pressurized gas proportional to the inhalation rate of the diver as well as to the depth the gas is breathed, which limits the amount of time a diver has available underwater to the amount of gas carried with them. As depths increase, ambient pressure increases by about 1 atmosphere for every 33 feet/10 meters. At a depth of 33 feet/10 meters, the diver is subjected to 2 atmospheres of pressure (one atmosphere at the surface plus one additional for the 33 feet/10 meters of water) and a scuba tank will last only ½ as long as it would at the surface, and at depths of 300 feet now commonly visited by divers, that same tank will last about 1/10 the duration at the surface.

As time underwater and depth continue to increase, divers increase the size and quantity of tanks until the bulk and complexity are too much to handle. To deal with this issue, divers are turning to devices known as re-breathers that capture exhaled gas in one or more flexible storage container, known commonly as a counterlung, and return a portion to the diver for re-breathing. By recycling the breathed gas, re-breathers extend usable time from a given amount of gas, by as much as 20 times. To recycle exhaled gas, the re-breather must eliminate unwanted carbon dioxide ($CO_2$) naturally introduced by the body as part of the respiration process or death can result. To do this, re-breathers process breathing gas in a loop like fashion to pass through a device known as a $CO_2$ scrubber containing a suitable chemical agent such as lime that chemically absorbs $CO_2$, releasing heat and water in a well understood process. As long as the scrubber is appropriately sized and designed, $CO_2$ free gas results that is then returned back to the diver to be breathed again, forming what is known in totality as a breathing loop.

In all presently implemented systems, re-breathed gas is driven through the loop directly by the breathing pressure of the diver and present art re-breathers require more breathing effort compared to open circuit, thus it is very important to minimize flow restrictions in the breathing loop to maintain the work of breathing (WOB) to reasonable levels. The duration and $CO_2$ removal capability of the scrubber is increased by employing larger, more complex scrubbers filled with agent made with finer sized granules that all act together to increase the total available active surface area, and unfortunately, also act to increase the WOB required in the loop. Work of breathing and scrubber duration are two of the most important performance criteria for re-breathers since it is critical to the survival of the diver that they be able to breathe easily enough to adequately ventilate the body with enough metabolic oxygen to survive as well as expel $CO_2$ that is metabolically produced by the body. Once outside the body, $CO_2$ must be continually and effectively removed from the breathing loop by the scrubber or an incapacitating condition known as hypercapnia can result which, although it might be survivable at the surface, can easily lead to death while underwater. It is particularly desirable to reduce the WOB of the entire rebreathing system and add safety features that would otherwise not be practical due to the associated increase in WOB such as an improved $CO_2$ scrubber.

One idea to reduce WOB that several divers have considered and typically rejected for reasons of complexity, uses compressed gas carried by the diver to assist the counterlung in expansion and contraction during breathing such as described in U.S. published patent application No. 2001/0015203. This approach, teaches about a device that adds pressurized drive gas to a small isolated sub-section of the flexible storage container that collects exhaled breathing gas from the diver, where the added drive gas acts to assist the diver in the exhalation process. Inhalation is also assisted by bleeding off the added pressurized drive gas to allow the flexible storage container to forcibly contract. The device trades work by the diver for work by the drive gas acting on the flexible storage container to move breathing gas through the loop resulting in a reduction in WOB by the diver. The extra motive force created by the drive gas acting on the flexible storage container also creates higher pressures in the breathing loop rather than in the diver's lungs. With each breathe, the volume of added drive gas builds up and must be vented from the loop or an over pressurize condition will result. The device features one way pressure relief valves to rid the breathing loop of this excess breathing gas and exhaust it to the surrounding environment. Ideally, this exhaust would occur once the flexible storage container is fully expanded and cannot contain additional gas. In this case assisted breathing no longer will function and the diver must create the motive force to expel the excess gas. Accordingly, these one way valves must be set to open at a pressure low enough that allows the diver to comfortably expel excess breathing gas without assistance when the loop is filled to full capacity. Unfortunately, the higher loop pressures that occur during assisted breathing causes breathing gas to undesirably escape from the loop through the one way pressure relief valves set to relieve at these lower pressures and extensive testing has shown that so much breathing gas is lost as to render the concept useless. It would be extremely desirable to provide an assisted re-breathing device that does not prematurely leak breathing gas to the surrounding environment during assisted breathing which also provides for unassisted exhalation of excess breathing gas from the loop to the surrounding environment by the diver with a lower breathing pressure similar to open circuit scuba.

In prior art re-breathers, additional one way valves are used to ensure un-scrubbed exhale gas laden with $CO_2$ is not re-breathed and is instead directed to pass properly through the scrubber. These valves are typically located as close to the mouth as possible to minimize the volume of gas that can be directly re-inhaled, one positioned to allow exhaled gas to pass down into the re-breather for temporary storage and scrubbing and a separate one turned in the opposite direction to receive scrubbed gas back from the re-breather and pass it back to the diver for inhalation. Most one way valves are designed as simple flexible membranes that under reverse flow conditions, normally act to effectively seal off flow passages and open only under forward flow conditions to allow flow to move in the proper direction around the loop. These one way valves resist the flow of breathing gas and add to the WOB, increasing resistance with increased breathing gas flow. To reduce WOB, a minimum number of one way valves are used and their size is maximized. Many accidents have been reported involving the failure of one way valves that allowed exhaled gas to be directly re-inhaled, leading to buildup of $CO_2$ in the loop. It is highly desired to maintain loop flow direction integrity when failure of a one way check valve occurs.

Particularly insidious is that hypercapnia can arise quite rapidly. A condition commonly known as breakthrough occurs when the scrubbing agent is depleted in any location enough to allow a significant portion of $CO_2$ to pass through the scrubber, rendering it unusable. It is well understood that heavy breathing and/or deeper depths cause $CO_2$ to pass further through the scrubber which can lead to early breakthrough. Breakthrough can also occur due to improper packing of the agent into the scrubber with a condition known as channeling, where re-breathed gas follows a low resistance to gas flow path that quickly depletes the locally surrounding scrubbing agent and allows $CO_2$ to prematurely channel through the scrubbing bed. Warning systems for the presence of $CO_2$ have only recently been introduced with limited success due to extreme sensitivity exhibited by available sensors to high relative humidity environments such as what exists naturally in a re-breather loop. Prior art systems that do exist, employ barriers made of sponges and/or water impermeable membranes placed between the loop and the sensor to limit water intrusion, which unfortunately also degrades the response time of the sensor, making it relatively ineffective when $CO_2$ rapidly builds up, or worse, can render the sensor useless if water saturation of the barrier occurs. Instead, most divers today rely on indirect measurements such as the time a scrubbing agent bed has been in service versus conservative experience as well as the direct measurement of scrubber temperature to determine when to stop using the bed. Since the scrubbing process naturally generates heat, a temperature rise indicates the agent is being activated by the presence of $CO_2$ and when this occurs near the end of the bed, it is time to stop using the re-breather. Unfortunately, $CO_2$ breakthrough tends to occur quite suddenly, especially during periods of heavy exertion and/or at deeper depths, making predictions based on time and temperature quite fallible. Due to significant safety concerns, re-breather divers would like to quickly and reliably monitor for the life threatening presence of $CO_2$ in the loop, especially at higher work levels and/or deeper depths when a rapid buildup can occur without warning.

Re-breathers also must provide make up for oxygen absorbed from inhaled gas by the body to satisfy the metabolic needs of the diver. It is well understood that at constant workload, the rate of metabolic oxygen consumption is more or less constant, requiring roughly the same number of $O_2$ molecules per unit time, meaning oxygen consumption is proportional to mass flow. Additionally, it is well known that metabolism and associated oxygen consumption by the divers body, changes more or less proportional to workload and respiration rate, therefore the harder you work, the higher the respiration rate, and the larger the mass flow requirement for metabolic makeup oxygen. Similar to open circuit gas consumed with depth, if a fixed mass sample of oxygen were isolated in a flexible container at the surface, it would shrink to ½ the volume at 33 feet and 1/10th the volume at 300 feet, yet this fixed mass would sustain the diver for the same period of time metabolically. Overall, metabolic consumption requires makeup oxygen volumetric flow to increase proportional to respiration rate and drop inversely proportional to depth induced pressure.

In diving operations, the amount of oxygen present in the breathing gas is measured in terms of oxygen partial pressure or $PO_2$, usually expressed in standard atmospheres of pressure. Normal oxygen at the surface is 21% of one atmosphere and is expressed as 0.21 $PO_2$, whereas 100% pure oxygen at the surface is 1.00 $PO_2$. It is well recognized that for safe diving operations, the oxygen content of breathing gas should always remain in the range of about $0.16<PO_2<1.60$. Too little oxygen, known as hypoxia, is a deadly condition that occurs below around 0.16 $PO_2$, where insufficient oxygen is present to sustain life. Too much oxygen, termed hyperoxia, becomes toxic over time to the central nervous system (CNS). Commonly referred to by divers as CNS toxicity, high oxygen levels eventually lead to uncontrolled convulsions, which when convulsions occur underwater, place the diver at extreme risk of death due to drowning. Typically this condition strikes without warning, and evidence supports that toxicity is accelerated by elevated $CO_2$ levels. Several prior art methods are used in re-breathers, that attempt to maintain safe levels of oxygen in the breathing loop.

One method, such as employed in U.S. Pat. No. 6,526,971 and present art rebreathers known as the RB80, forcibly eject a portion of the exhaled gas from the loop that is replaced by passive addition of a gas mix containing some amount of oxygen, linked to the respiration rate of the diver. Oxygen levels in the loop drop and stabilize to several percent below injected levels. Divers must be very careful not to allow hypoxia to set in, especially at shallower depths where the percent drop is amplified. Another method allows the diver to manually actuate a valve to add oxygen to the loop as required. Yet another method bleeds oxygen into the loop using a fixed orifice driven by a special regulator designed to maintain a constant, absolute pressure on one side of the orifice, with ambient pressure on the other, with enough differential pressure to cause sonic flow through the orifice. As ambient pressure increases with depth, pressure across the orifice drops, producing a roughly constant mass flow of oxygen as depth changes in a well understood process that is not linked to the respiration rate of the diver. As ambient pressure increases sufficiently to cause the orifice to drop into sub-sonic operation, mass flow is reduced, ultimately to zero when ambient pressure equals the set pressure of the absolute pressure regulator. In these systems, the diver normally chooses an orifice sized to produce flow somewhat below their resting metabolic rate such that an occasional manual add of oxygen is required to make up for any shortfall and more frequent additions are required at deeper depths when the orifice goes sub-sonic and with increased workloads. It is very important in these systems that the diver closely monitor oxygen content within the breathing loop so that timely additions can be made to remain safe. Another system automatically monitors and controls oxygen addition using an electronic closed loop computer control system that periodically cycles an electric oxygen addition valve to maintain oxygen levels within the loop. Electronic systems are susceptible to failure in underwater environments and it is very important that oxygen monitoring sensors be accurate to facilitate safe operation of re-breathers employing them.

Prior art oxygen monitoring within the re-breathing loop is commonly accomplished using some form of galvanic sensor which unfortunately, are proven in practice to not be all that reliable. Sensors typically exhibit a relatively short life expectancy of just several months to a year or two, are also susceptible to malfunction when exposed to condensing water and provide little warning they are about to fail. When they do wear out or fail, they report oxygen levels different from what is actually present. Due to reliability concerns, divers typically employ multiple sensors, sequence them in age, and even employ sophisticated real time computer algorithms to determine the health and believability of sensors. In the end, sensor health is left up to the diver to evaluate and this requires constant vigilance to remain safe. It is particularly desirable to eliminate the need for electronic controls and sensor feedback to properly add and maintain oxygen levels in underwater re-breathing devices.

BRIEF SUMMARY OF THE INVENTION

A constant mass oxygen addition device for use with a re-breathing apparatus that remains unaffected by ambient pressure changes, which in underwater applications, occurs often, due to depth changes by the diver. The constant mass oxygen addition device comprises a chamber that is first pressurized with regulated pressure gas containing oxygen to a set value greater than ambient pressure and then subsequently vented to ambient pressure. This defines one constant mass dosing cycle. Multiple constant mass dosing cycles are repeated sequentially on a periodic basis sufficient to replace metabolic oxygen used by the diver, controlled electronically or preferentially independent of electronics, and preferably linked to the respiratory rate of the diver.

Further, to make up differing metabolic needs of the diver, such as under varying workload conditions, adjustment of the delivered oxygen mass in each dosing cycle can be accomplished by adjusting the volume of the intermediate chamber and/or by altering the regulation pressure of the connected oxygen supply, allowing for on the fly, fine tune adjustments of gas mix in the breathing loop.

Other features and advantages will become apparent from the following detailed description, the drawings, and the claims.

DETAILED DESCRIPTION OF THE INVENTION

Figure 1A:
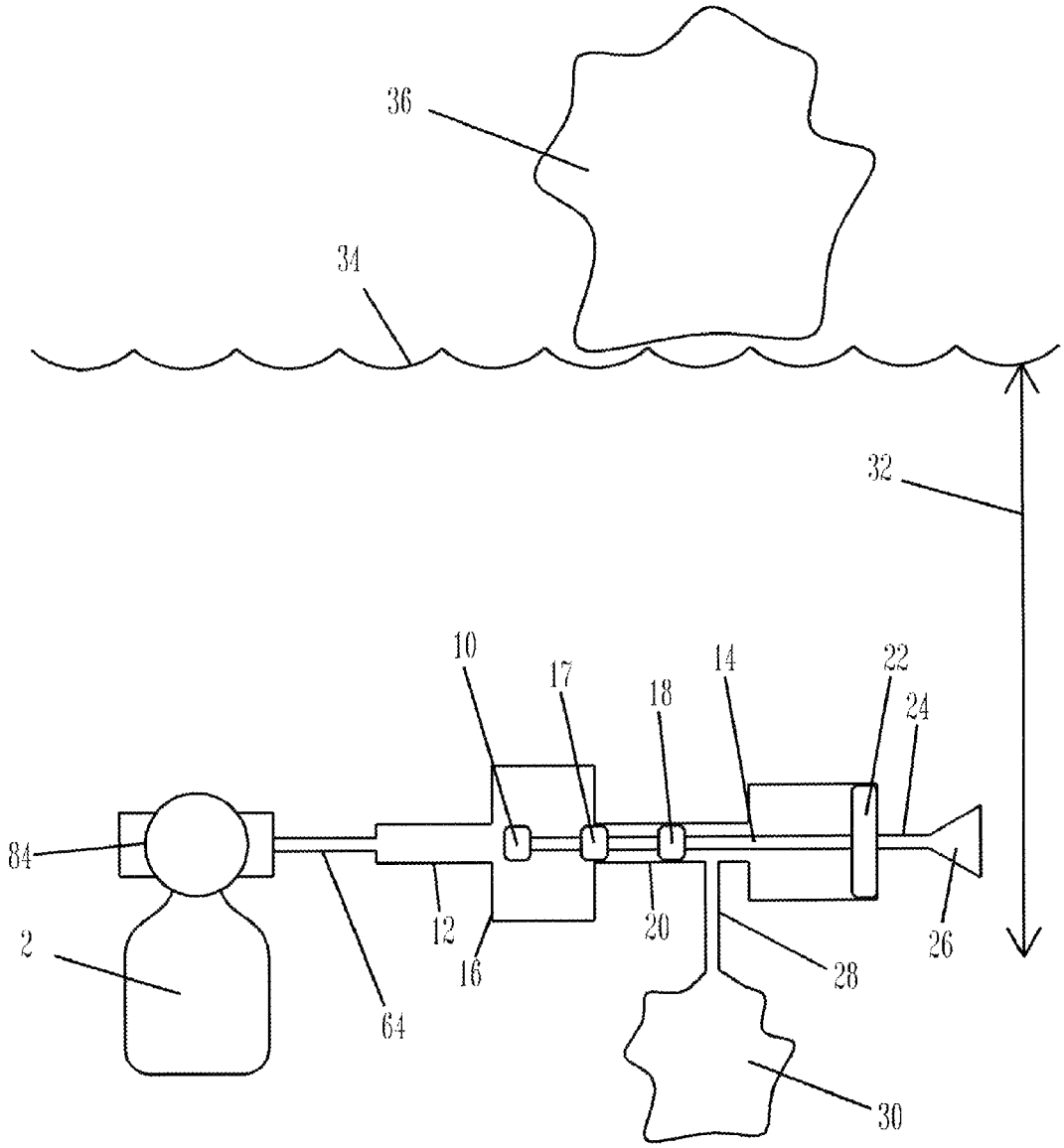
FIG. 1*a* is a schematic cross section view of a pneumatically actuated, constant mass oxygen addition device independent of ambient pressure changes in the pressurized state.
Figure 1B:
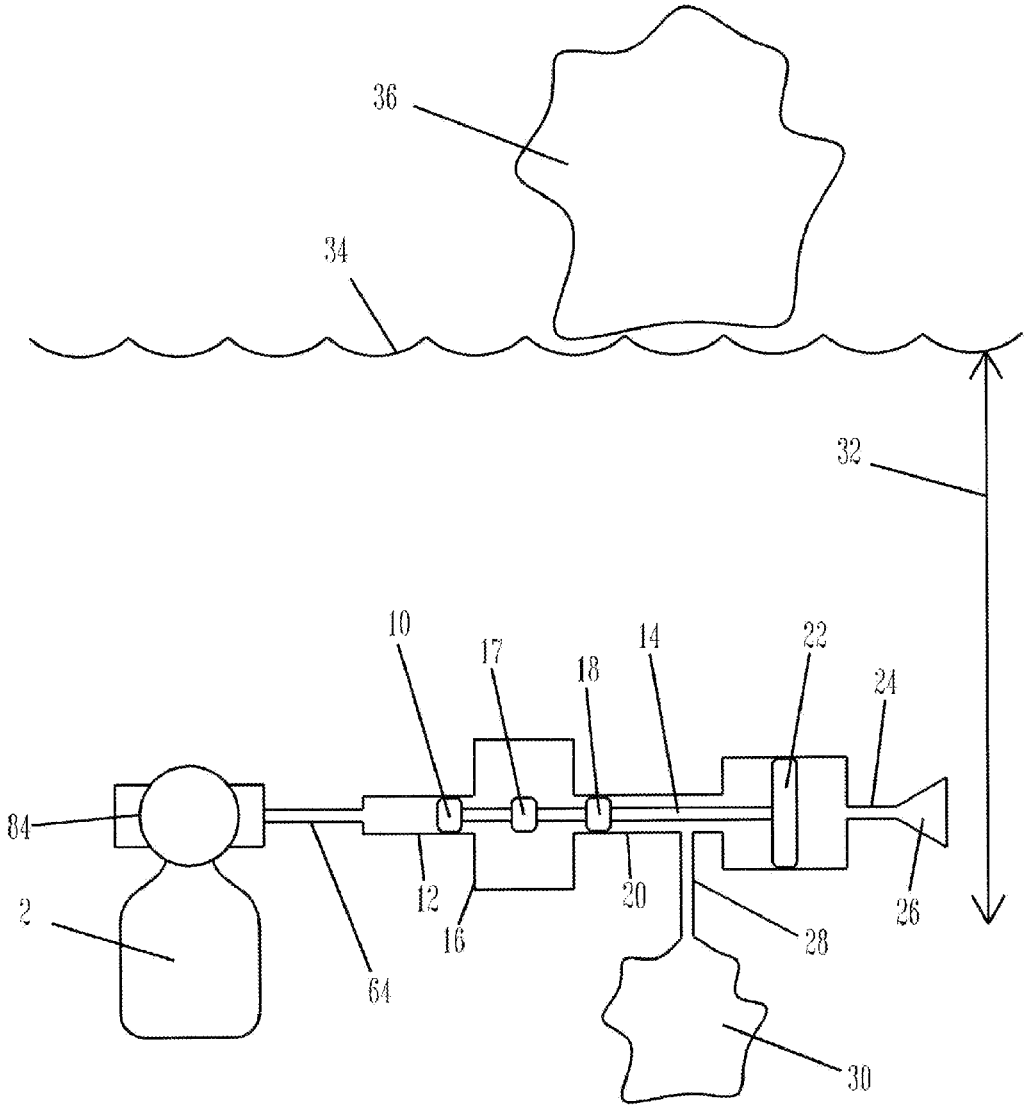
FIG. 1*b* is a schematic cross section view of a pneumatically actuated, constant mass oxygen addition device independent of ambient pressure changes in a transitioning, middle position state.
Figure 1C:
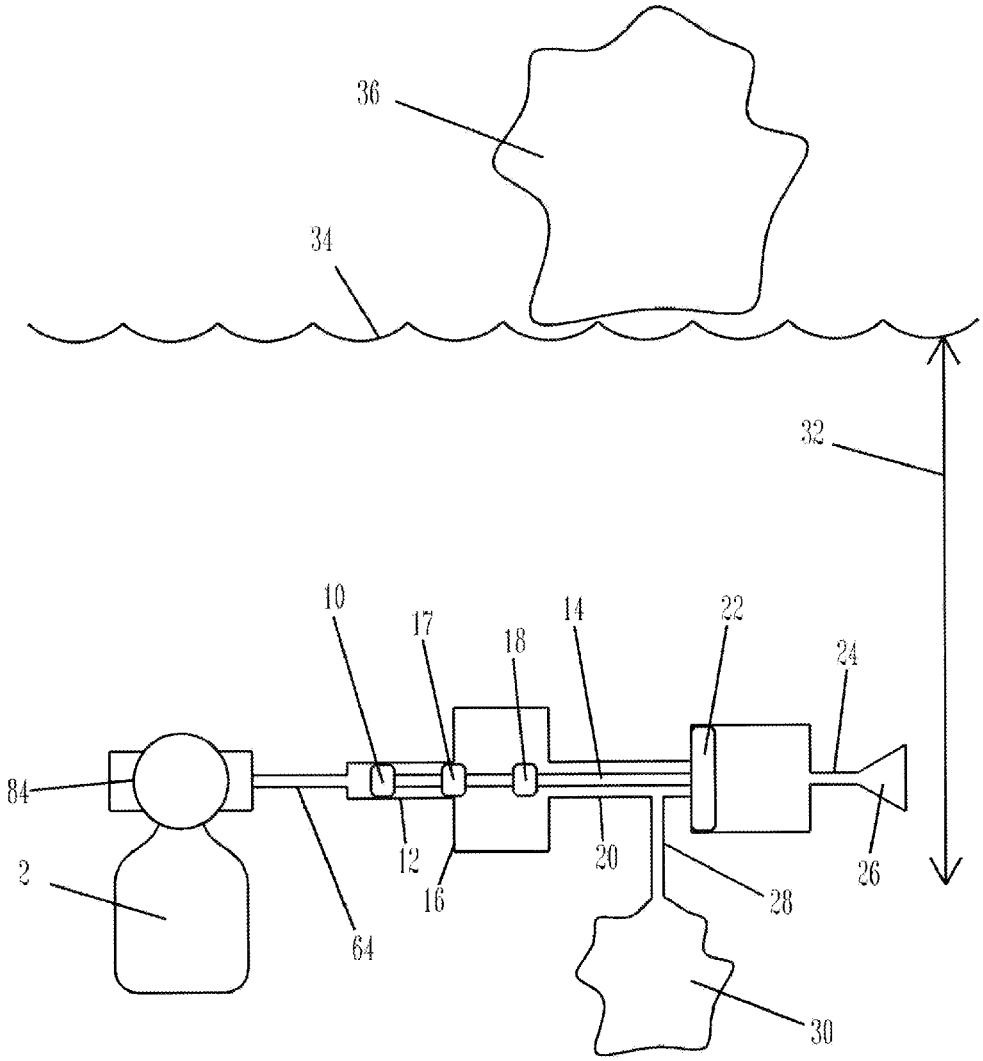
FIG. 1*c* is a schematic cross section view of a pneumatically actuated, constant mass oxygen addition device independent of ambient pressure changes in the depressurized state.

FIGS. 1*a*, 1*b*, and 1*c* show a preferred configuration of a constant mass oxygen addition device which alternately pressurizes with regulated pressure gas containing oxygen to a set value greater than ambient pressure, and subsequently depressurizes to ambient pressure, an intermediate chamber 16, thereby delivering one constant mass dosing cycle of metabolic oxygen.

Referring to FIG. 1*a*, stored pressurized gas containing oxygen inside high pressure gas storage bottle 2, is regulated to pressure Preg above surrounding ambient pressure Pamb by pressure regulator 84. In diving applications, it is preferred to use commonly available off the shelf scuba regulators that require no modification for this purpose. Regulated gas piston 10, located fully inside intermediate chamber 16, forms an open, pressurizing isolation valve, that allows regulated pressure gas containing oxygen to flow through connecting tube 64 to fully pressurize regulated piston chamber 12 and intermediate chamber 16 to Preg above Pamb which acts on regulated gas piston 10 and optional redundant piston 17 sealed inside vent chamber 20. Here, a lower control pressure is applied by variable pressure regulating device 26 through control inlet 24 to a common actuator made up of control piston 22 and piston spool 14. Variable pressure regulating device 26 can be without limit, any device capable of delivering pressurized actuating (control) gas at a changeable pressure such as described in concurrently filed co-pending application, by the same inventor as the present application, entitled GAS ASSISTED RE-BREATHING DEVICE, assigned U.S. application No. 13/016,664 and hereby incorporated by reference. The lower control pressure applied to control piston 22, applies a force to piston spool 14 which is insufficient to overcome the force applied to piston spool 14 by regulated gas piston 10 and optional redundant piston 17 with applied pressure Preg above Pamb, forcing piston spool 14 to remain fully in the direction of control piston 22. Optional redundant piston 17 and/or vent piston 18 inside vent chamber 20 form a closed, venting isolation valve, that holds piston spool 14 in place until pressure is equalized and the system reaches steady state and that further acts to prevent regulated pressure gas containing oxygen from passing out through vent tube 28 into the surrounding environment. Optional redundant piston 17 is not required but acts redundantly to ensure no unwanted regulated pressure gas containing oxygen leaks through into the surrounding environment. If the control pressure applied by variable pressure regulating device 26 through control inlet 24 increases sufficiently to push on control piston 22 such that the force applied to piston spool 14 is just large enough to overcome the force applied by regulated gas piston 10 and optional redundant piston 17 with applied pressure Preg above Pamb, piston spool 14 will begin to move in the direction of regulated gas piston 10.

Now referring to FIG. 1*b*, control pressure applied by variable pressure regulating device 26 through control inlet 24 has increased sufficiently to force piston spool 14 to move in the direction of regulated gas piston 10 through a the middle transition position shown, such that intermediate chamber 16 now at pressure Preg above Pamb is sealed by regulated gas piston 10 inside of regulated piston chamber 12 forming a closed, pressurizing isolation valve on one side, and vent piston 18 inside of vent chamber 20 continuing to form a closed, venting isolation valve on the opposite side of intermediate chamber 16, trapping a fixed volume of regulated pressure gas containing oxygen, Vtrapped, at a pressure of Preg above Pamb. Optional redundant piston 17, if used, preferentially moves fully across intermediate chamber 16 during the transition. The required control pressure that must be applied by variable pressure regulating device 26 to just shift piston spool 14 is proportional to Pamb+Preg and the surface area of vent piston 18, and inversely proportional to the surface area of control piston 22.

Further referring to FIG. 1*c*, piston spool 14 has moved fully in the direction of regulated gas piston 10. Control pressure applied by variable pressure regulating device 26 through control inlet 24 is high enough and pushes on control piston 22 hard enough such that the force applied to piston spool 14 is large enough to completely overcome the force applied to piston spool 14 by regulated gas piston 10, optional redundant piston 17, and vent piston 18, all with applied pressure Preg above Pamb, forcing piston spool 14 to fully move and remain in the direction of regulated gas piston 10 such that regulated gas piston 10 and optional redundant piston 17, move inside of regulated piston chamber 12, forming a closed, pressurizing isolation valve, that holds piston spool 14 in place, acting to isolate regulated pressure gas containing oxygen and prevent flow through connecting tube 64 into intermediate chamber 16. As vent piston 18 fully enters intermediate chamber 16, forming an open, pressurizing isolation valve, regulated pressure gas containing oxygen vents from intermediate chamber 16 through vent chamber 20 and vent tube 28 into the surrounding environment, until Vtrapped reaches steady state at pressure Pamb, releasing vented volume 30, Vvent, to the surroundings also at pressure Pamb.

From well understood gas laws at a constant temperature, $$P\times V(\text{FIG. 1}a)=P\times V(\text{FIG. 1}c)$$

$$(P\text{amb}+P\text{reg})\times V\text{trapped}=P\text{amb}\times(V\text{trapped}+V\text{vent})$$

therefore, $$V\text{vent}=(P\text{reg}\times V\text{trapped})/P\text{amb}$$

At or near water surface 34, Pamb has a value Psurface which equals 1 atmosphere (1 ATA). Below water surface 34, Pamb is dependent on depth 32 below water surface 34 and increases by about 1 ATA for every depth 32 increase of 33 feet or 10 meters. Vented volume 30 at any depth 32 with an associated ambient pressure Pamb, if taken at or near surface 34 to a constant pressure of Psurface, from gas laws, will have a surface volume 36, Vsurface, $$P\text{surface}\times V\text{surface}=P\text{amb}\times V\text{vent}$$

substituting for $V$vent, $$V\text{surface}=V\text{trapped}\times P\text{reg}/P\text{surface}.$$

Pressure regulator 84 maintains Preg at a fixed pressure above Pamb and Vtrapped is a fixed volume contained by regulated gas piston 10 inside of regulated piston chamber 12 on one side and vent piston 18 inside of vent chamber 20 on the other, trapping a fixed volume of regulated pressure gas containing oxygen as piston spool 14 shifts, therefore surface volume 36 is fixed independent of depth 32 below water surface 34. Since surface volume 36 is fixed and is at a fixed pressure Psurface, therefore vented volume 30 represents a fixed mass, amount or dose of gas containing oxygen independent of ambient pressure, Pamb.

The process completes by causing variable pressure regulating device 26 to return to a low control pressure, forcing piston spool 14 to move back in the direction of vent piston 18 passing in the reverse direction through the transition state depicted in FIG. 1*b*, but now with intermediate chamber 16 at pressure Pamb, until it reaches the state described in FIG. 1*a* with intermediate chamber 16 at pressure Preg+Pamb completing one fixed mass dosing cycle independent of ambient pressure.

For re-breathing diving applications, the regulated pressure gas containing oxygen is typically pure oxygen, or some mix containing elevated levels of oxygen above the normal 21% found in air, that is dosed to maintain a breathable gas within a re-breathing loop to support life and make up for oxygen metabolized by the diver. The fixed mass dosing cycle independent of ambient pressure described by FIGS. 1*a*, 1*b* and 1*c* can be repeated any number of times to provide any number of surface volume 36 equivalent, or fixed mass doses of gas containing oxygen. The repetition rate of completed dosing cycles defines a fixed mass dosage rate of gas containing oxygen independent of depth 32 suitable to provide for the metabolic makeup needs of a re-breathing individual. Typically it is desired to adjust the fixed mass dosage rate of gas containing oxygen such that the net mass dosage rate of oxygen is equal to metabolized rate so that the oxygen content in a re-breathing loop is maintained relatively constant.

Figure 2:
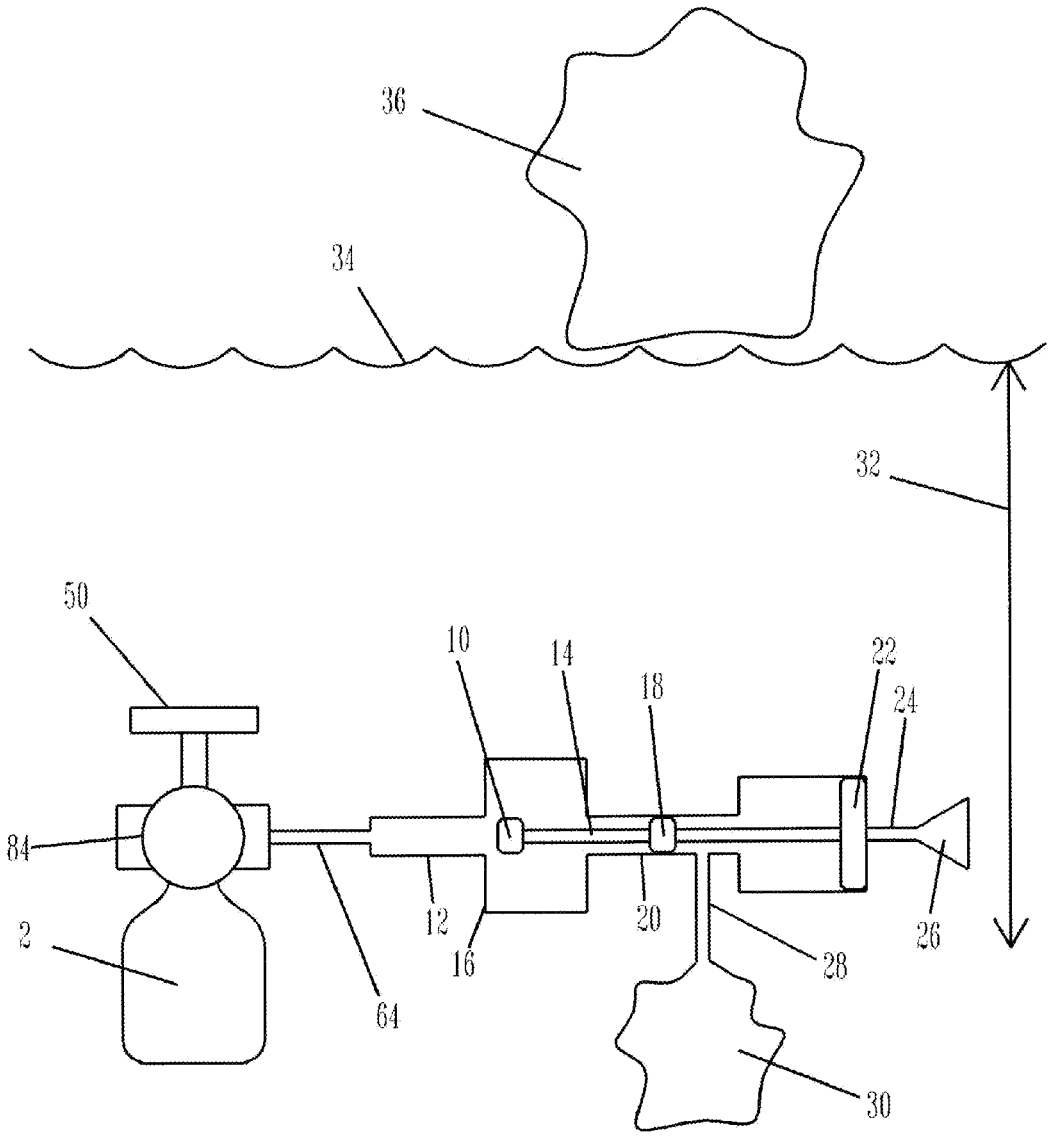
FIG. 2 is a schematic cross section view of a pneumatically actuated, constant mass oxygen addition device independent of ambient pressure changes of FIG. 1*a*, with adjustable regulation pressure.

Referring now to FIG. 2, regulated pressure adjustment 50 is added to pressure regulator 84 to allow for adjustment of set pressure Preg above surrounding ambient pressure Pamb by pressure regulator 84 resulting in corresponding adjustment of surface volume 36. The device otherwise performs the same as described in FIGS. 1*a*, 1*b* and 1*c* except optional redundant piston 17 is not shown installed. Pressure regulator 84 can be of any regulating means since the method of regulation is not important.

Figure 3:
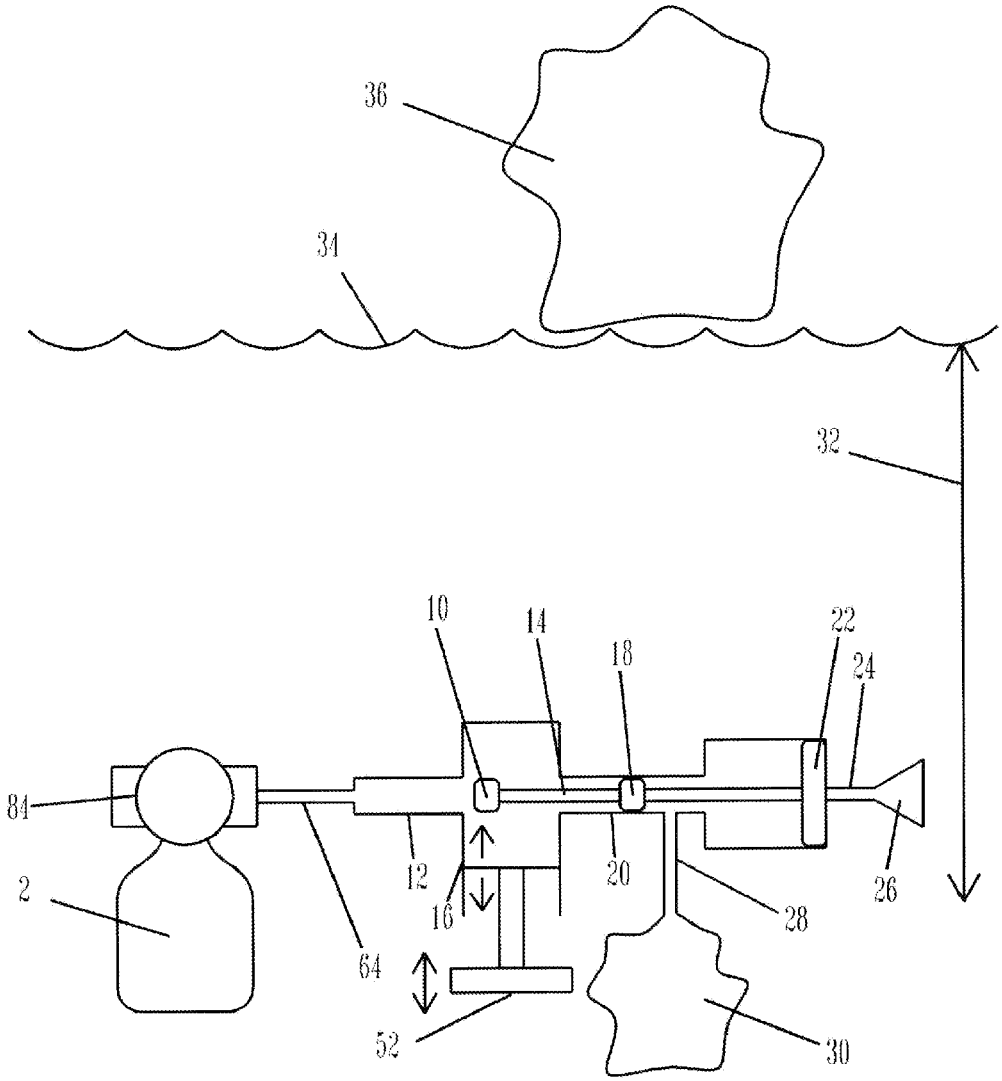
FIG. 3 is a schematic cross section view of a pneumatically actuated, constant mass oxygen addition device independent of ambient pressure changes of FIG. 1*a*, with adjustable trapped volume.

Referring to FIG. 3, volume adjustment device 50 is added preferably to intermediate chamber 16 (shown) or anywhere else that always remains connected to intermediate chamber 16 throughout the dosing cycle to allow for adjustment of volume Vtrapped resulting in corresponding adjustment of surface volume 36. The device otherwise performs the same as described in FIGS. 1*a*, 1*b*, and 1*c* except optional redundant piston 17 is not shown installed. Volume adjusting device 50 can be of any adjusting means since the method of adjustment is not important.

It is understood that the motive force for positioning piston spool 14 can be created in any convenient manner including by electrical solenoid and that gas piston 10 and vent piston 18 can be separated and controlled independently in a sequence that acts to first trap a fixed volume of regulated pressure gas containing oxygen at pressure Pamb+Preg and then later release it to pressure Pamb yielding a vented volume 30 that represents a fixed mass, amount or dose of gas containing oxygen independent of ambient pressure, Pamb.

The invention has been described in detail with particular reference to a presently preferred embodiment, but it will be understood that variations and modifications can be effected within the spirit and scope of the invention. The presently disclosed embodiments are therefore considered in all respects to be illustrative and not restrictive. The scope of the invention is indicated by the appended claims, and all changes that come within the meaning and range of equivalents thereof are intended to be embraced therein.

The invention claimed is:

1. A method of providing a constant mass oxygen dose independent of an ambient pressure in a re-breather, the method comprising:

(a) providing an intermediate chamber having a fixed operational volume, the intermediate chamber selectively fluidly connected to a regulated pressure oxygen containing gas source and a venting chamber;

(b) pressurizing the intermediate chamber with a regulated pressure oxygen containing gas from the regulated pressure oxygen containing gas source to a pressure greater than ambient pressure;

(c) isolating the pressurized isolating chamber from the regulated pressure oxygen containing gas source and (d) subsequently venting the intermediate chamber to ambient pressure to deliver a constant mass oxygen dose.

2. The method of claim 1, further comprising pressurizing the intermediate chamber by actuating a pressurizing isolation valve; venting the intermediate chamber by a venting isolation valve and precluding a simultaneous opening of the pressurizing isolation valve and the venting isolation valve.

3. The method of claim 2, further comprising employing a common actuator for actuating the pressurizing isolation valve and the venting isolation valve.

4. The method of claim 3, further comprising pneumatically driving the common actuator.

5. The method of claim 4, further comprising linking the pneumatic driving of the common actuator to a breathing pattern of user.

6. The method of claim 2, wherein actuating at least one of the pressurizing isolation valve and the venting isolation valve causes the regulated gas to act upon at least one additional seal.

7. The method of claim 1, further comprising adjusting the operational volume of the intermediate chamber.

8. The method of claim 1, further comprising adjusting the pressure of the regulated pressure oxygen containing gas.

9. The method of claim 1, wherein steps (a) and (b) are repeated over time and linked to a breathing pattern of a user to provide for makeup of metabolic oxygen used over time by the user.

10. The method of claim 1, wherein the pressurizing and the venting are accomplished with separate pressurizing and venting actuators.

11. The method of claim 1, wherein the pressurizing and the venting is one of mechanically and electrically controlled.

12. A constant mass oxygen addition device, independent of ambient pressure, for use in a re-breather having a source of oxygen containing gas at a fixed pressure above ambient pressure and a variable pressure control gas source above ambient pressure, the device comprising:

(a) a fixed operational volume intermediate chamber;

(b) a pressurizing isolation valve fluidly intermediate the oxygen containing gas at a fixed pressure and the intermediate chamber, wherein the pressurizing isolation valve is moveable to an open position passing the oxygen containing gas from the source of oxygen containing gas to the intermediate chamber;

(c) a venting isolation valve fluidly intermediate the intermediate chamber and ambient pressure, the venting isolation valve moveable to an open position exposing the intermediate chamber to ambient pressure; and (d) a common pneumatic actuator operably connected to the pressurizing isolation valve and the venting isolation valve to preclude the pressurizing isolation valve and the venting isolation valve being simultaneously in the open position;

wherein the common pneumatic actuator is acted upon by the variable pressure control gas and the oxygen containing gas at a fixed pressure.

13. The constant mass oxygen addition device of claim 12, wherein the intermediate chamber is pressurized by actuation of the pressurizing isolation valve.

14. The constant mass oxygen addition device of claim 12, wherein the common pneumatic actuator is linked to a breathing pattern of a user.

15. The constant mass oxygen addition device of claim 12, wherein a volume of the intermediate chamber is adjustable.

16. The constant mass oxygen addition device of claim 12, wherein the fixed pressure of the oxygen containing gas is adjustable.

17. The constant mass oxygen addition device of claim 12, further comprising at least one additional seal acting on at least one of the pressurizing isolation valve and the venting isolation valve.

* * * * *